US007470163B2

(12) United States Patent
Lokken et al.

(10) Patent No.: US 7,470,163 B2
(45) Date of Patent: Dec. 30, 2008

(54) COMBINED RISER, OFFLOADING AND MOORING SYSTEM

(75) Inventors: Roald T. Lokken, Houston, TX (US); W. Brett Wilson, Spring, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 9 days.

(21) Appl. No.: 11/662,007

(22) PCT Filed: Aug. 11, 2005

(86) PCT No.: PCT/US2005/028732

§ 371 (c)(1),
(2), (4) Date: Mar. 6, 2007

(87) PCT Pub. No.: WO2006/036325

PCT Pub. Date: Apr. 6, 2006

(65) Prior Publication Data

US 2008/0096448 A1 Apr. 24, 2008

Related U.S. Application Data

(60) Provisional application No. 60/613,834, filed on Sep. 28, 2004.

(51) Int. Cl.
*B63B 21/50* (2006.01)
*B63B 22/02* (2006.01)
*B63B 27/24* (2006.01)

(52) U.S. Cl. ..... 441/3; 441/4; 114/230.1

(58) Field of Classification Search ..... 141/387; 114/230.1, 230.2, 293; 441/3–5
See application file for complete search history.

(56) References Cited

U.S. PATENT DOCUMENTS 5,639,187 A 6/1997 Mungall et al. ..... 405/195.1
6,415,828 B1 7/2002 Duggal et al. ..... 141/387

(Continued)

FOREIGN PATENT DOCUMENTS

GB 1 581 325 A 12/1980

(Continued)

OTHER PUBLICATIONS

European Standard Search Report No. RS 112036 US, 3 pages.

(Continued)

*Primary Examiner*—Ajay Vasudeva

(57) ABSTRACT

A combined riser, offloading and mooring system is provided for the offloading of hydrocarbons from a floating production vessel (FPV), onto a tanker. The system preferably includes an offloading buoy tethered to the mudline by at least one mooring line. The offloading buoy and the mooring line can be part of an offloading buoy system for supporting a production riser and fluid jumper lines. Additionally, the offloading buoy system can support an offloading jumper line from the FPV to a fluid connector on the offloading buoy system through which hydrocarbon fluid is loaded via an offloading hose onto a tanker. The combined riser, offloading and mooring system also preferably includes at least one set of FPV mooring lines for securing the floating production vessel to the offloading buoy system. The system further preferably includes a hawser line for connecting the tanker to the offloading buoy system. In this manner, the number of mooring lines for the floating production vessel may be reduced.

29 Claims, 6 Drawing Sheets

U.S. PATENT DOCUMENTS

| | | | | |
|---|---|---|---|---|
| 6,558,215 | B1 * | 5/2003 | Boatman | 441/5 |
| 6,571,723 | B1 | 6/2003 | Bech et al. | 114/230.2 |
| 6,685,519 | B1 | 2/2004 | Bech et al. | 441/4 |
| 6,688,348 | B2 | 2/2004 | Fontenot | 141/387 |
| 2004/0238176 | A1 * | 12/2004 | Appleford et al. | 166/353 |

FOREIGN PATENT DOCUMENTS

| | | | |
|---|---|---|---|
| GB | 2 351 724 | A | 1/2001 |
| IE | 990 872 | A2 | 4/2001 |
| JP | 61287892 | | 12/1986 |
| WO | WO 00/64732 | | 11/2000 |
| WO | WO 03/013948 | | 2/2003 |

OTHER PUBLICATIONS

PCT International Search and Written Opinion, 6 pages.

Connaire, A. et al. (1999) "An Innovating Concept for a Combined Riser Mooring (CRM) System," Deepwater Offshore Technology Conference, Stavenger Norway, 20 pages.

Ronalds, B. F. et al. (1999) "FPSO Trends", *Society of Petroleum Engineers*, SPE 56708, 15 pages.

* cited by examiner

COMBINED RISER, OFFLOADING AND MOORING SYSTEM

CROSS REFERENCE TO RELATED APPLICATIONS

This application is the National Stage of International Application No. PCT/US2005/028732 filed 11 Aug. 2005, which claims the benefit of U.S. Provisional Patent Application No. 60/613,834 filed on Sep. 28, 2004.

BACKGROUND

1. Field of the Inventions

Embodiments of the present invention generally relate to mooring, riser and offloading systems for offshore hydrocarbon production developments. More specifically, embodiments of the present invention relate to the offloading of hydrocarbon fluids from a floating facility to an export tanker.

2. Description of Related Art

During the past thirty years, the search for oil and gas offshore has moved into progressively deeper waters. Wells are now commonly drilled at depths of several thousand feet below the surface of the ocean. In addition, wells are now being drilled in more remote offshore locations.

The drilling and maintenance of deep and remote offshore wells is expensive. In an effort to reduce drilling and maintenance expenses, remote offshore wells are oftentimes drilled in clusters. This allows a single floating rig or semi-submersible vessel to conduct drilling operations from essentially a single ocean location. Further, this facilitates the gathering of production fluids into a local production manifold after completion. Fluids from the clustered wells are commingled at the manifold, and delivered together through a single flowline. The manifold may be located subsea, or may be positioned on an offshore production platform.

From the manifold, produced fluids are delivered downstream by means of a subsea production flowline. The flowline carries the fluids to a processing facility, typically under pressure emanating from the originating subterranean reservoirs. The gathering facility collects and commingles fluids as produced from multiple wells.

In offshore fields where the metocean conditions are considered benign, the processing facility may be located offshore proximate to the subsea well-site. The coasts of West Africa, Indonesia, Malaysia and Brazil are examples of marine areas considered to have calm weather conditions. In such deepwater areas, a floating vessel may be the processing facility. Such vessels are referred to as "floating production vessels," or FPV's. Such vessels are also sometimes referred to as "floating production, storage and offloading systems," or "FPSO's." For ease of reference, the term "FPV" will be used herein. FPV's may include equipment for treating fluids, such as by separating produced water from the produced hydrocarbons. The facility may further separate gas and liquid phase hydrocarbons before offloading. Produced hydrocarbons may be held at the FPV for future offloading and delivery to market.

It is desirable that an FPV maintain its geographic position offshore. The process of maintaining position offshore is called "stationkeeping." To provide stationkeeping for the FPV, multiple sets of mooring lines can be used to secure the FPV to the ocean bottom. In areas of calm weather conditions, the mooring lines can be arranged in a "spread-mooring" pattern. For example, two sets of front lines may be provided, and two sets of rear lines may be provided. The lines may have a first end connected to the vessel, and a second point anchored at the ocean mudline. The various lines are typically 1 to 4 km in length, depending on water depth and other factors. Spread-moored systems keep the FPV headed in a single direction, oftentimes in the direction of the prevailing weather conditions. This eliminates the high cost of providing a turret mooring system that lets the FPV weathervane in response to wind, waves, and current.

In order to offload hydrocarbons from the FPV for delivery to market, a transport vessel or tanker is brought adjacent the FPV offshore. The bow of the tanker can be positioned behind the stern of the floating production vessel (tandem offloading) . The two vessels may be tied together by a hawser line. A floating offloading hose is then connected from the FPV to the tanker in order to transfer fluids onto the tanker. The offloading conduit commonly ties into a midship manifold on the tanker. The close proximity of the tanker to the production vessel creates a hazard of contact. The potential result is loss of valuable hydrocarbons, damage to one or both vessels, and possibly even harm to the marine environment.

In an effort to mitigate this danger, an independent mooring system, which may include a surface offloading buoy, can be used for securing the position of the tanker relative to the FPV. One example is a catenary anchor leg mooring (CALM). The tanker positioning system can be a separate set of mooring lines, augmented by use of a tug boat or "tender vessel" connected to the tanker with tow lines. Tension is maintained in the towlines so as to maintain the tanker at an assured clear distance from the FPV. In some instances, dynamic positioning may also be employed on the tanker to maintain a safe distance.

The installation of deepwater mooring systems offshore for production vessels and offloading systems is expensive. Mooring systems have been offered as an alternative to a pure spread-mooring system. Examples of mooring systems are described in U.S. Pat. Nos. 5,639,187 and 6,571,723. Another example is the combined riser mooring system, or "CRM." The CRM system integrates a riser mooring buoy into a spread-mooring system for the FPV. The CRM technology was published at the Deepwater Offshore Technology Conference in Stavanger, Norway in October 1999. Additional information relating to mooring, riser and/or offloading systems can be found in: U.S. Pat. No. 6,685,519; IE 990 872 A2; WO 03/013948; GB1 581 325 A; and Patent Abstracts of Japan, vol. 011, no. 157 (M-590), 21 May 1987 (May 21, 1987) & JP 61 287892 A (Mitsubishi Heavy Industries, Ltd.), 18 Dec. 1986 (Dec. 18, 1986).

SUMMARY

A combined riser, offloading and mooring system is provided for the offloading of hydrocarbons from a floating production vessel (FPV) onto a tanker. The system has utility in a marine environment, such as the ocean. The system is configured to combine separate mooring systems for the FPV and the offloading system, thereby saving installation costs.

The combined riser, offloading and mooring system first includes an offloading buoy system. The offloading buoy system is designed to support a production riser, and also to support a pair of fluid connectors.

The offloading buoy system first includes an offloading buoy. The offloading buoy is tethered to the mudline by at least one mooring line. The at least one mooring line is preferably a single, substantially vertical mooring line that is anchored in the mudline. The at least one mooring line forms a vertical axis with the mudline, with the offloading buoy being disposed substantially in the vertical axis of the mooring line.

The offloading buoy system also includes a riser connector. The riser connector provides mechanical and fluid communication between the production riser and a production jumper. The production jumper delivers fluids to the floating production vessel. In this way, production fluids are carried from subsea wells to the floating production vessel.

The offloading buoy system may include a fluid conduit connector. The connector provides fluid communication between a jumper line from the floating production vessel and an offloading hose to the export vessel. In this way, fluids may be exported from the floating production vessel to the export tanker.

The combined riser, offloading and mooring system may include at least one set of FPV mooring lines. The FPV mooring lines serve to secure the FPV to the offloading buoy system. In one arrangement, the connection is made at the offloading buoy. The FPV mooring lines allow at least one set of lines in the known spread-mooring system to be eliminated.

The combined riser, offloading and mooring system may also include a hawser line for connecting the tanker to the offloading buoy system. In one arrangement herein, the hawser line is connected directly to the offloading buoy. In this manner, the number of mooring lines for the floating production vessel is reduced, and the need for an independent mooring system (such as a single point mooring system with a CALM buoy) for the tanker is removed.

In one arrangement, the offloading buoy system also includes a turntable. The turntable is disposed on the offloading buoy. In one arrangement, the offloading buoy and connected turntable are disposed below the ocean surface with the offloading buoy. In another arrangement, the offloading buoy pierces the ocean surface, allowing the turntable to be visible. The hawser line can be connected to the turntable. In this manner, the position of the tanker is secured. At the same time, the tanker is permitted to weathervane in response to changing weather and ocean conditions without need of a separate single point mooring.

In one arrangement, the offloading buoy system further includes a riser buoy. The riser buoy can be connected to the offloading buoy by an inter-buoy mooring line or tether that connects the buoys. This allows the offloading buoy to be placed at the ocean surface, while the riser buoy remains submerged. The riser connector is placed at the riser buoy.

One or more of the systems described herein addresses combinations of mooring elements in areas where the met-ocean conditions allow the use of a spread mooring (rather than turret mooring) for the FPV. The above systems reduce risks of offloading operations compared to offloading using tandem or side-by-side offloading.

An offloading buoy system is also provided. In one embodiment, the system includes a substantially vertical offloading mooring line secured to the ocean bottom; an offloading buoy moored by the mooring line, the offloading buoy being disposed substantially in an axis formed by the offloading mooring line; a fluid conduit connector for providing fluid communication between first and second fluid lines, the first fluid line being a jumper line carrying fluids from a floating production vessel, and the second fluid line being a floating offloading hose carrying those fluids to a tanker; a riser connector disposed along the offloading mooring line for supporting a riser and for providing fluid communication between the production riser and a production jumper to the floating production vessel; an FPV mooring line for tethering the FPV to the offloading buoy system; and a hawser line for connecting the tanker to the offloading buoy.

BRIEF DESCRIPTION OF THE DRAWINGS

A description of certain embodiments of the inventions is presented below. To aid in this description, drawings are provided, as follows.

DETAILED DESCRIPTION

Description of Specific Embodiments

Figure 1A:
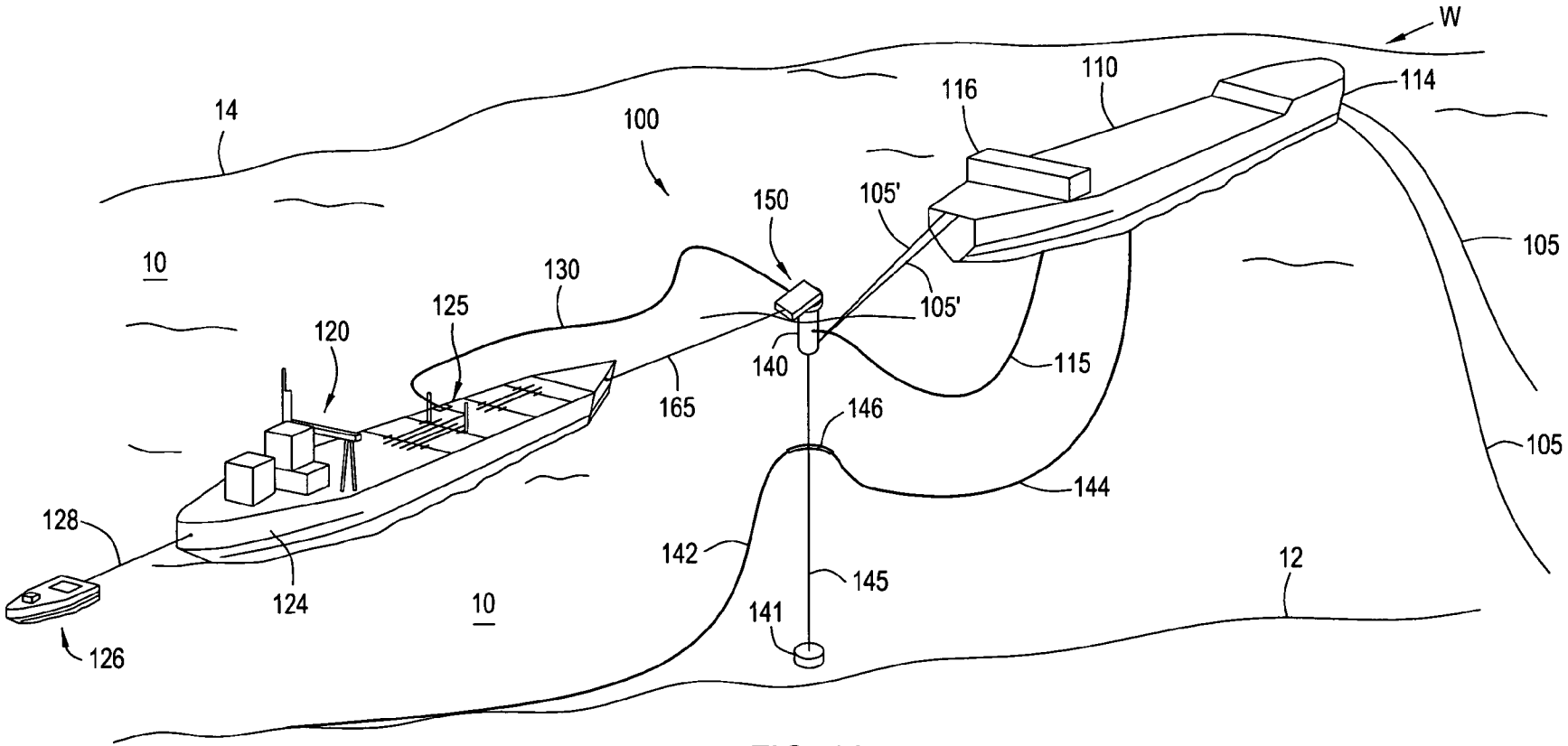
FIG. 1A presents a perspective view of a combined riser, offloading and mooring system for the offloading of hydrocarbons from an FPV onto a tanker in accordance with one embodiment of the present invention. A set of rearward mooring lines for the FPV is secured to the supporting buoy for a production riser. The riser buoy is at the water surface. The buoy includes an optional turntable for mooring to the export tanker.

The following provides a description of specific embodiments of the present invention:

A combined riser, offloading and mooring system for the offloading of hydrocarbons from a floating production vessel to a tanker is provided, in various embodiments. The floating production vessel receives the hydrocarbons from a production riser and production jumper line. The floating production vessel then processes the fluids, and delivers them through an offloading jumper line to an offloading buoy system. From the offloading buoy system the processed fluids are conveyed by a floating offloading hose to a tanker. In one aspect, the system includes an offloading buoy system for supporting the production riser and production jumper line; at least one set of FPV mooring lines for securing the floating production vessel to the offloading buoy system; and a hawser line for connecting the tanker to the offloading buoy system.

The offloading buoy system includes at least one offloading buoy mooring line forming a mooring line axis from an earth mudline; an offloading buoy connected to the at least one offloading buoy mooring line, the offloading buoy being disposed substantially in the mooring line axis; a fluid conduit connector for providing fluid communication between a jumper line from the floating production vessel and a floating offloading hose to the export tanker; and a riser connector for providing fluid communication between the production riser and a production jumper to the floating production vessel.

The at least one offloading buoy mooring line preferably is a substantially vertical offloading mooring line secured to the ocean bottom.

The offloading buoy system may further comprise a turntable for receiving the hawser line, with the turntable being configured to permit the tanker to pivot. The offloading buoy and connected turntable may be at the ocean surface or may be submerged.

The offloading buoy system may further comprise a riser buoy. The riser buoy may be is submerged beneath the offloading buoy, may also be moored by the offloading buoy mooring line, may be disposed substantially in the vertical axis formed by the at least one offloading buoy mooring line, and may be connected to the offloading buoy by an inter-buoy mooring line.

In one aspect, the fluid conduit connector defines a gooseneck supported below the ocean surface by the offloading buoy mooring line. The production riser connects to a first end of the gooseneck, and a production jumper connects to a second end of the gooseneck, and delivers production fluids from the gooseneck to the FPV. The production riser is preferably a catenary riser for delivering production fluids to the riser connector.

The at least one set of mooring lines may be connected to the offloading buoy system. Connection may be at, for example, the offloading buoy or another point along the at least one mooring line.

A method for mooring a floating production vessel and intermittently mooring an export tanker for the offloading of fluids in a marine environment is also provided. In one embodiment, the method comprises the steps of positioning an offloading buoy system at a selected location in a marine environment; positioning the floating production vessel in proximity to the offloading buoy system; and mooring the floating production vessel by connecting the floating production vessel to the offloading buoy system by means of mooring lines. Then, during operations, the method further includes the steps of positioning the tanker in proximity to the offloading buoy system; and mooring the tanker to the offloading buoy system by connecting the tanker to the offloading buoy system by means of a hawser line.

The offloading buoy system includes at least one offloading buoy mooring line forming a vertical axis; an offloading buoy moored by the at least one offloading buoy mooring line, the offloading buoy being disposed substantially in a vertical axis formed by the at least one offloading buoy mooring line; a riser connector disposed along the vertical mooring line axis for supporting a production riser and providing fluid communication between the riser and a production jumper to the floating production vessel; a fluid conduit connector for providing fluid communication between an offloading jumper line carrying fluids from the floating production vessel and a floating offloading hose carrying those fluids to a tanker; an FPV mooring line for tethering the floating production vessel to the offloading buoy system; and a hawser line for connecting the tanker to the offloading buoy.

In one aspect, the method further includes the steps of operatively connecting a first fluid line to the offloading buoy, the first fluid line being the jumper line carrying fluids from the floating production vessel to the offloading buoy; and operatively connecting a second fluid line to the offloading buoy, the second fluid line being the floating offloading hose carrying fluids from the first fluid jumper line to the tanker.

One embodiment of the invention includes using any of the above-described combined riser, offloading and mooring systems to produce petroleum hydrocarbons.

One embodiment of the invention includes a method of producing petroleum hydrocarbon fluids. The method includes mooring a floating production vessel in a marine environment by connecting the floating production vessel to an offloading buoy system using mooring lines, mooring a tanker to the offloading buoy system by connecting the tanker to the offloading buoy system using a hawser line, unloading a fluid from the floating production vessel to the tanker through a fluid conduit connector, a first fluid line and a second fluid line, and transporting the fluid to a second location.

The offloading buoy system may include at least one offloading buoy mooring line forming a vertical axis with a mudline in the marine environment, an offloading buoy moored by the at least one offloading buoy mooring line, the offloading buoy being disposed substantially in a vertical axis formed by the at least one offloading buoy mooring line, a fluid conduit connector for providing fluid communication between first and second fluid lines, the first fluid line being a jumper line carrying fluids from a floating production vessel, and the second fluid line being a floating offloading hose carrying those fluids to a tanker, a riser connector disposed along the vertical mooring line for supporting a riser, an FPV mooring line for tethering the floating production vessel to the offloading buoy system, and a hawser line for connecting a tanker to the offloading buoy.

Description of Embodiments Shown in the Drawings

Described herein are various combined riser, offloading and mooring systems. Explicit references to the drawings are included. FIG. 1A presents a first embodiment of a combined riser, offloading and mooring system 100 for the offloading of hydrocarbons from a floating production, storage and offloading vessel (FPV) onto a tanker. The system 100 is deployed in a remote and deepwater environment 10. The system 100 is shown in perspective view in an ocean environment in FIG. 1A; however, it is understood that the systems of the present inventions are operable in any calm marine environment where an FPV can be spread moored.

In FIG. 1A, an FPV is shown at 110, while a tanker is shown at 120. The tanker 120 has been brought adjacent the FPV 110 for offloading operations. First 115 and second 130 fluid transfer conduits are shown. The first conduit 115 is an offloading jumper line, and is used to offload production fluids from the FPV 110. The second conduit 130 is an offloading hose, and is used to deliver fluids from the offloading jumper line 115 to the tanker 120. The floating offloading hose 130 has been connected to a midship manifold 125 on the tanker 120. As will be discussed more fully below, a fluid connection is made between the first 115 and second 130 conduits to effectuate the offloading process.

Figure 1B:
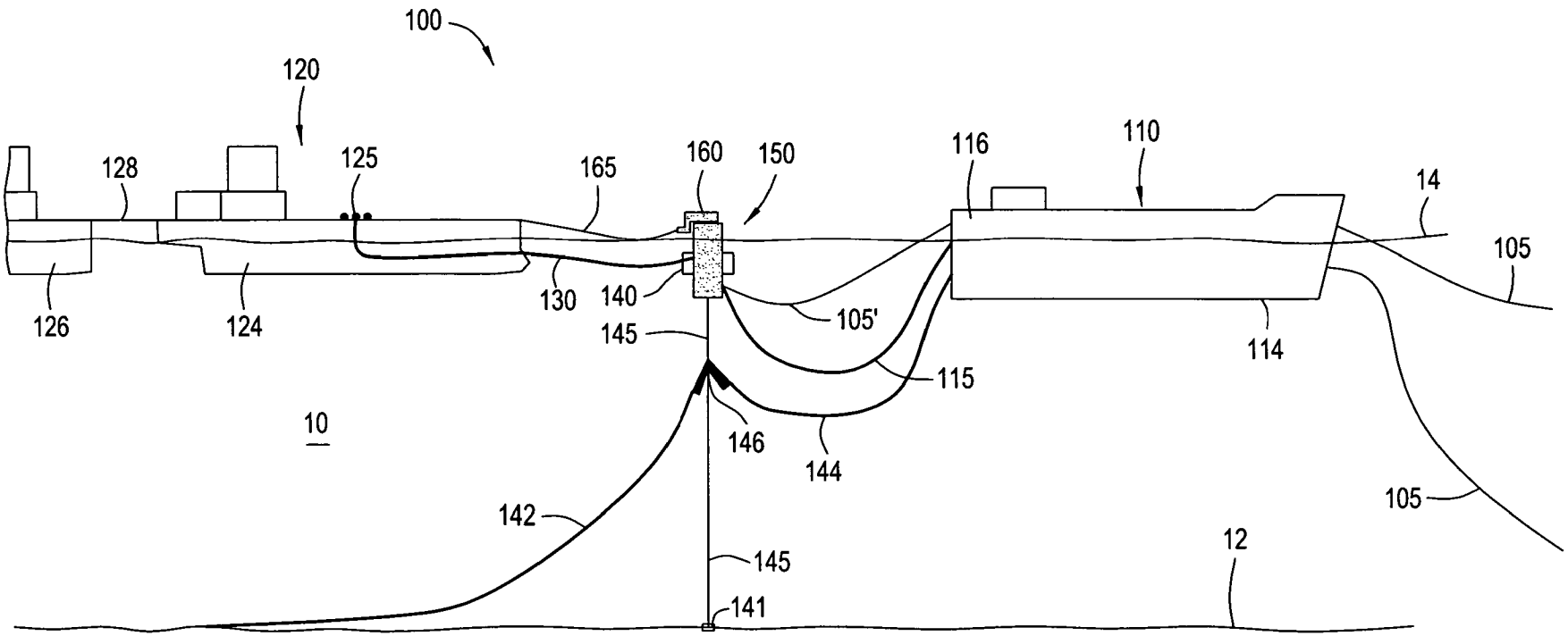
FIG. 1B shows a side view of the combined riser, offloading and mooring system of FIG. 1A.
Figure 1C:
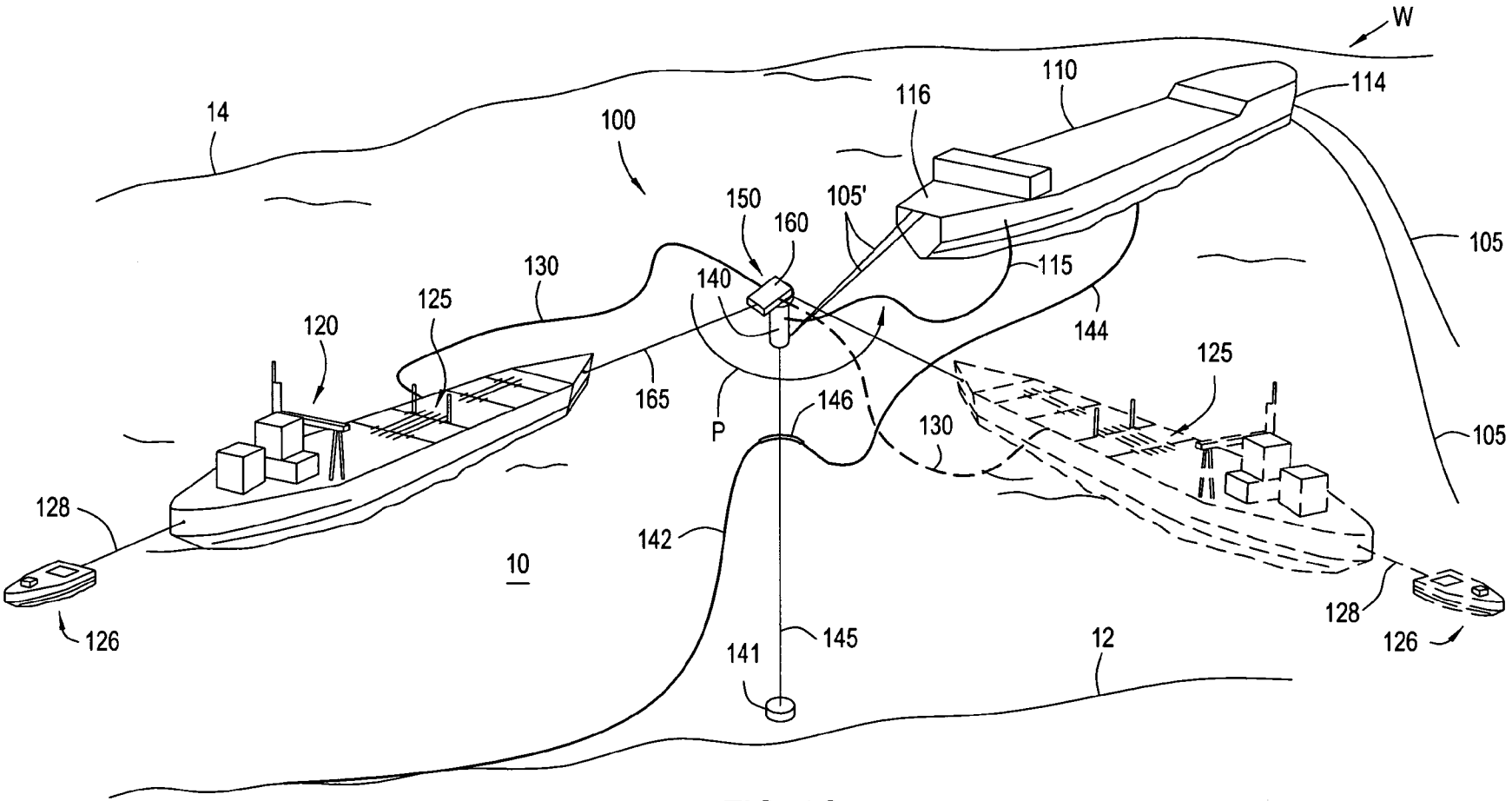
FIG. 1C provides a perspective view of the combined riser, offloading and mooring system of FIG. 1B. It can be seen in FIG. 1C that the export tanker has pivoted about the turntable.

FIG. 1A shows the combined riser, offloading, and mooring system 100 in perspective view in an ocean body 10. The ocean bottom, or "mudline," is seen at 12. The ocean surface is seen at 14. FIG. 1B shows the same system 100 in side view. FIG. 1C demonstrates the system 100 in perspective view; however, in this view the tanker 120 has pivoted, or "weathervaned," about pivot axis P.

The combined riser, offloading, and mooring system 100 stabilizes the relative location of the FPV 110 and the tanker 120. The floating vessel 110 may be a floating platform. Alternatively, the vessel 110 may be a ship-shaped vessel. A ship-shaped vessel may or may not be self-propelled. A ship-shaped vessel may be oriented in the direction of the prevailing weather patterns, i.e., wind and waves. In the arrangement of FIG. 1A, the vessel 110 is ship-shaped, with a bow shown at 114. Arrow W shows the direction of weather conditions.

The tanker 120 is likewise oriented so that its bow 124 is directed into the prevailing weather condition W.

In one arrangement, one or more small tender vessels or tugs are optionally moved into position behind the tanker 120. A single tender vessel 126 is shown in FIG. 1A. Lines 128 are then attached to the tender vessel 126 at one end, and to the tanker 120 at the other end. Tension is maintained in the one or more hawser lines 165 so as to maintain the tanker 120 at an assured clear distance from the FPV 110

The combined riser, offloading and mooring system 100 first includes an offloading buoy system 150. The offloading buoy system 150 first includes an offloading buoy 140. With the aid of the offloading buoy, the offloading buoy system 150 is designed to support a production riser 142, and to also support a riser connector 146 and a fluid connector 166. The offloading buoy 140, the riser connector 146 and the fluid connector 166 are more clearly seen in the enlarged perspective view of FIG. 4.

Returning to FIG. 1A, the offloading buoy 140 is tethered to the mudline 12 by at least one mooring line 145. The at least one mooring line 145 is preferably a single vertical mooring line that is anchored in the mudline 12. The mooring line 145 is anchored to the ocean bottom 12 by known means, such as gravity, piled base or suction anchor 141. It is understood that the at least one mooring line 145 may be a plurality of mooring lines. The one or more mooring lines 145 form a mooring line axis. In one arrangement, the mooring line axis is a substantially vertical axis with respect to the earth surface, i.e., the mudline 12. However, the mooring line axis is intended to account for sway and design modifications of the system, and is further intended to account for and encompass sway induced by marine currents, and is not limited to an orthogonal relationship to the mudline 12. The offloading buoy 140 is disposed substantially in the axis of the mooring line 145.

Figure 4:
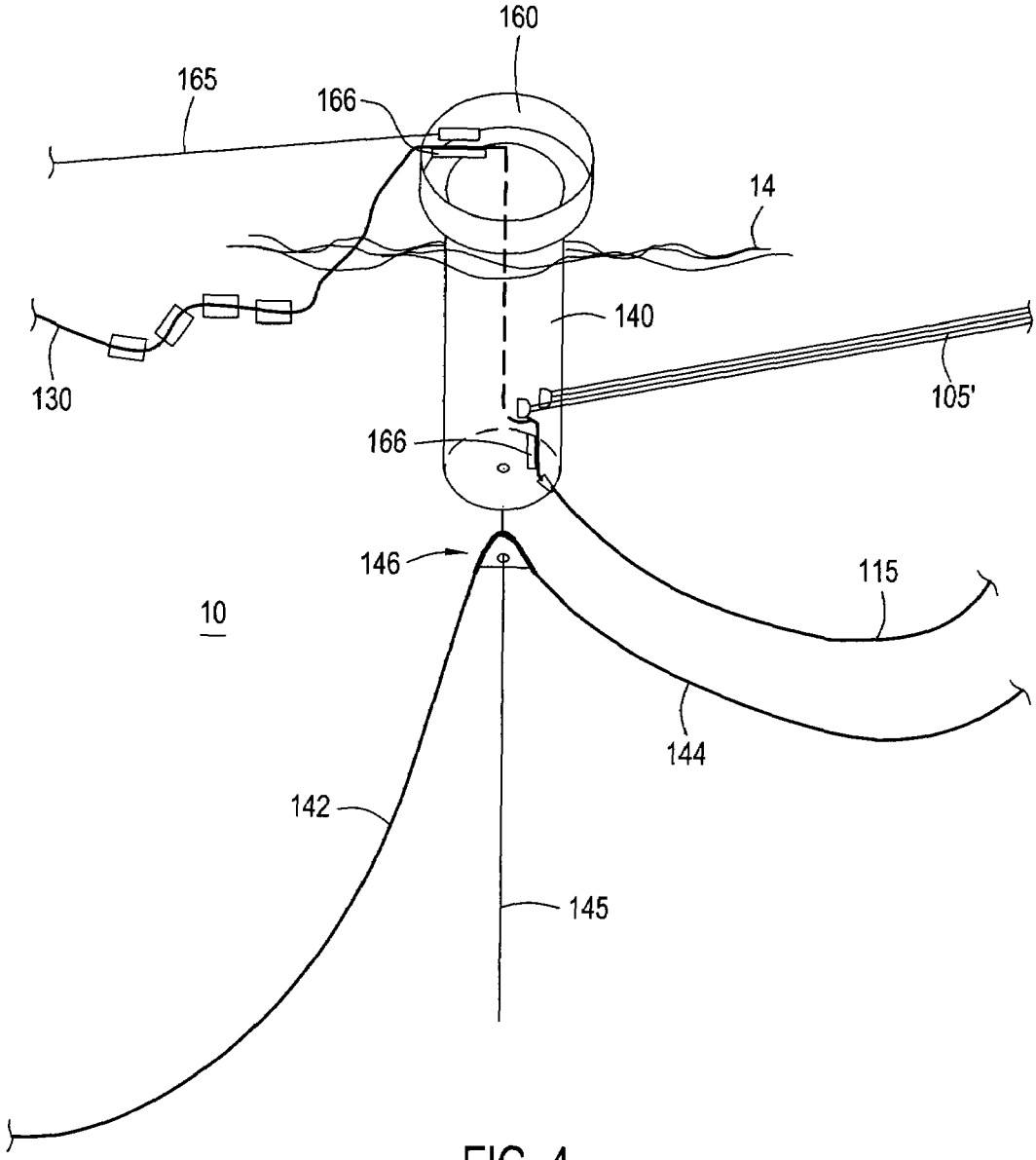
FIG. 4 provides a perspective view of an exemplary buoy as might be used as the offloading buoy in the systems of the present disclosure. A fluid conduit connector is seen along the buoy.

As mentioned, the offloading buoy system 150 also includes a riser connector 146. In one arrangement, the riser connector 146 defines a gooseneck having first and second ends. At one end, the gooseneck 146 ties into a production riser 142. A single catenary production riser 142 is shown in FIGS. 1A and 4. However, any riser system may be used in conjunction with the offloading buoy system 150. At the other end, the gooseneck 146 ties into a production jumper 144. Thus, the riser connector 146 provides fluid communication between a production riser 142 and a production jumper 144. In this way, production fluids are carried from subsea wells to the floating production vessel 110. The jumper 144 delivers fluids to the appropriate station on the floating vessel 110. There, fluids are processed, held and, ultimately offloaded.

Next, and as also mentioned above, the offloading buoy system 150 includes a fluid conduit connector 166 (shown in FIG. 4). The connector 166 provides fluid communication between an offloading jumper 115 from the floating production vessel 110, and a floating offloading hose 130 that leads to the export vessel 120. In this way, fluids are exported from the floating production vessel 110 to the export tanker 120.

The combined riser, offloading, and mooring system 100 next includes at least one set of FPV mooring lines 105'. The FPV mooring lines 105' serve to secure the floating production vessel 110 to the offloading buoy system 150. In one arrangement, the connection is made at the offloading buoy 140. However, the connection may be made through a separate connector (not shown) along the offloading buoy mooring line 145, or on a separate buoy placed within the general vertical axis of the offloading buoy mooring line 145, or even to the riser connector 146. The FPV mooring lines 105' allow at least one set of lines in a common spread-mooring system to be eliminated. In this respect, spread-mooring systems typically provide two or more sets of mooring lines at one end of a vessel, and two or more sets of mooring lines at an opposite end of the vessel. For the FPV 110 in FIGS. 1A-1C, a pair of conventional mooring lines 105 is seen. In this illustrative arrangement, the lines 105 are on the forward end 114 (or "bow") of the vessel 110. The lines 105 have a first end connected to the vessel 110, and a second point anchored at the ocean mudline 12. The various lines 105 are typically 1 to 4 km in length. The lines 105, 105' serve as mooring lines for stationkeeping of the FPV 110. However, on the opposite end 116 (the "stern") of the vessel 110, only one set of lines 105' is needed. Thus, in at least one embodiment, one set of spread-mooring lines has been eliminated.

The combined riser, offloading, and mooring system 100 also includes one or more hawser lines 165. The hawser lines 165 connect the transport vessel 120 to the offloading buoy system 150.

In one arrangement, the offloading buoy system 150 includes a turntable 160. The turntable 160 is shown in the plan view of FIG. 1B and the perspective view of FIG. 4. The turntable 160 is disposed above the offloading buoy 140. Preferably, the turntable 160 is fixed on a top surface of the offloading buoy 140. An example is the placement of a turntable on top of a catenary anchor leg mooring buoy, or "CALM" buoys. The turntable 160 is configured to permit the tanker 120 to weathervane in response to changing weather and ocean conditions. As demonstrated in the perspective view of FIG. 1C, the tanker 120 pivots about the turntable 160. The pivoting motion is demonstrated by arrow P. It is understood that the turntable 160 may provide only restricted pivoting.

In the arrangement of FIGS. 1A-1C, the FPV mooring lines 105' are tied into the offloading buoy 140. The hawser line 165 is tied into the turntable 160. However, in certain embodiments, the FPV mooring lines 105' and the hawser lines 165 may be tied into other components of the offloading buoy system 150. For example, the FPV mooring lines 105' may tie into the offloading buoy 140, to the gooseneck 146. The offset from the FPV 110 to the buoy 140 is preferably is great enough that it, coupled with the ability of the export tanker 120 to approach from a range of headings and to weathervane while hooked up to the single point moor 140, reduces risk compared to tandem offloading.

The offloading buoy 140 may be positioned either at the ocean surface 14, or may be submerged. In the arrangement of FIGS. 1A and 1B, the offloading buoy 140 and connected turntable 160 are at the ocean surface 14. Because the offloading buoy 140 pierces the ocean surface 14, the turntable 160 is visible to operators in working vessels. However, in another arrangement, the offloading buoy 140 and connected turntable 160 are submerged. Preferably, the offloading buoy 140 would be submerged below the ocean waveline to minimize damage from being passed across by a tanker. This latter arrangement is seen in the side view of FIG. 2.

Figure 2:
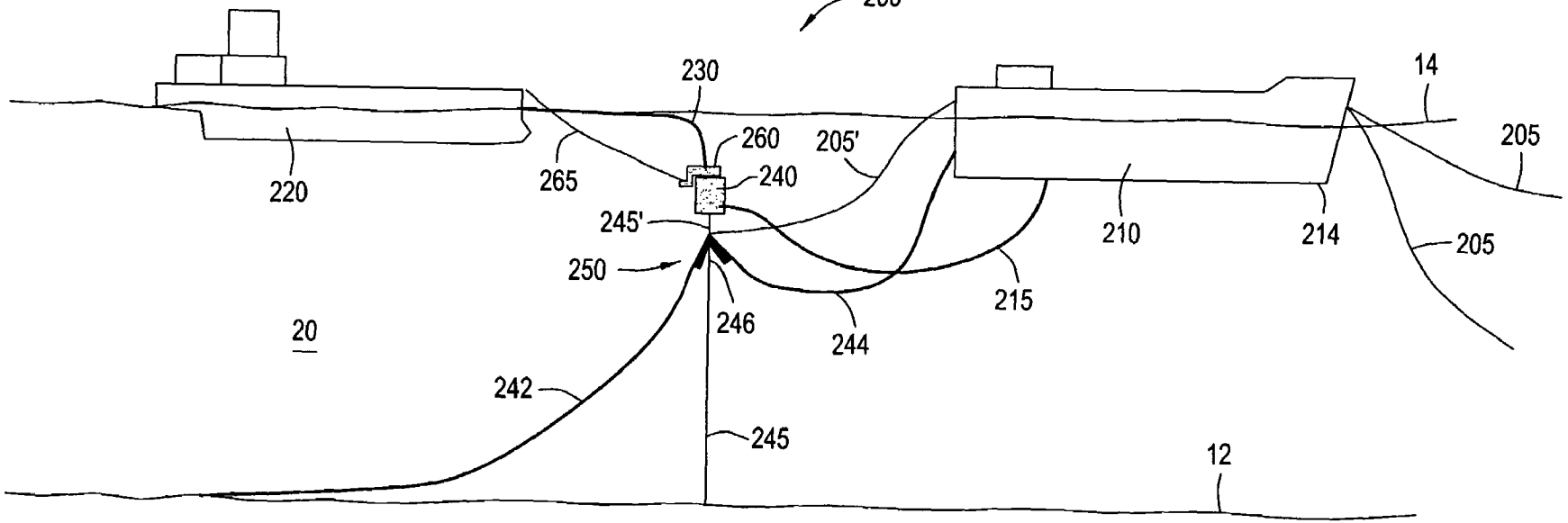
FIG. 2 presents an alternative combined riser, offloading and mooring system for the offloading of hydrocarbons from an FPV onto a tanker. In this arrangement, the riser buoy is submerged below the surface of the water. The turntable remains functional in the ocean.

FIG. 2 presents an alternate arrangement for a combined riser, offloading, and mooring system 200 for the offloading of hydrocarbons from an FPV onto a tanker. Visible again in this system 200 are an FPV 210, along with forward mooring lines 205 and aft mooring lines 205' for securing the position of the FPV 210. The aft lines 205' of the FPV 210 are connected to a gooseneck (riser connector) 246 below the ocean surface 14. The gooseneck 246, in turn, is tied to a vertical mooring line 245. The mooring line 245 is part of the offloading buoy system 250. Also connected to the vertical mooring line 245 are steel catenary risers 242 and a connected production jumper 244. Also connected to the gooseneck 246, and supporting the risers 242 and gooseneck 246, is a riser buoy 240.

As with system 100, the combined riser, offloading, and mooring system 200 is set up to deliver production fluids to an export tanker 220. The tanker 220 is tethered to a turntable 260 by hawser 265. The turntable 260, in turn, is disposed on a top surface of the offloading buoy 240. However, unlike system 100 in which the offloading buoy 240 and turntable 260 are at the ocean surface 14, in the system 200 the riser buoy 240 and turntable 260 are maintained below the ocean surface 14. Preferably, the turntable 260 is submerged below the depth where wave-induced forces are significant.

Figure 3:
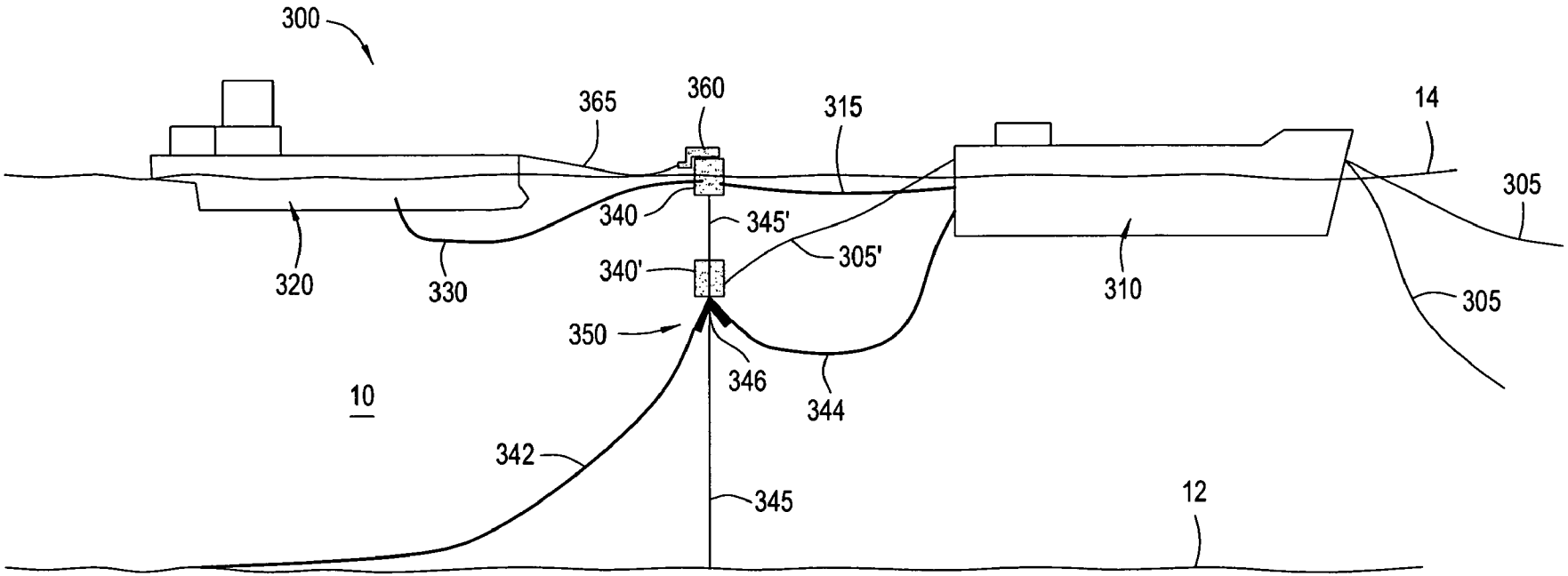
FIG. 3 presents yet another combined riser, offloading and mooring system for the offloading of hydrocarbons from an FPV onto a tanker. In this arrangement, the supporting buoy and the turntable have been separated. The riser buoy is below the surface of the water, while the turntable is placed at the water surface. A separate offloading buoy is used to support the turntable. The offloading buoy is positioned immediately above the riser buoy.

FIG. 3 presents a combined riser, offloading, and mooring system 300 for the offloading of hydrocarbons from an FPV onto a tanker in accordance with the present invention, in a third embodiment. In the arrangement of FIG. 3, an offloading buoy 340 is employed. The offloading buoy 340 is tethered to a mooring line 345. However, a separate riser buoy 340' is added to the offloading buoy system 350. The riser buoy 340' is connected to the mooring line 345. In addition, the riser buoy 340' is connected to the offloading buoy 340 by an inter-buoy mooring line 345'. The riser buoy 340' supports the one or more production risers 342. In the arrangement of FIG. 3, the offloading buoy 340 is buoyed at the ocean surface 12, while the riser buoy 340' is submerged.

The offloading buoy 340 is positioned immediately above the riser buoy 340'. By using a split buoy approach, an accident causing flooding of the surface-piercing buoy 340 should not result in excess motion of the steel catenary risers 342 suspended from the system, and also would maintain buoyant support of the risers 342 from the riser buoy 340'.

Certain functions performed by embodiments of this invention include, but are not limited to:

Mooring—mooring stiffness is provided by the steel catenary risers, the vertical mooring lines to the buoy, and the mooring lines between the offloading buoy system and the FPV;

Risers—the produced fluids are routed from the seabed through steel catenary risers to the goosenecks on the vertical mooring and through jumper pipes from the goosenecks to the FPV; and Offloading—Oil is exported through a jumper from the FPV to the buoy, through the turntable and the floating hose to the export tanker. The export tanker is moored by the hawser from the buoy.

A method for mooring a floating production vessel and an export tanker in a marine environment is also provided. Generally, the floating production vessel (such as FPV 110 of FIG. 1A) is positioned at a selected location in a marine body 10. The marine body 10 may be an ocean, a lake, or other water body. Next, an offloading buoy is placed in proximity to the floating production vessel. The offloading buoy may be buoy 140 shown in FIG. 1A. The FPV is then moored to the offloading buoy system by connecting mooring lines from the floating production vessel to the offloading buoy system. Connection may be at various places along the offloading buoy system (such as systems 250 or 350), including but not limited to the offloading buoy 240, the riser buoy 340, the fluid connector 346, or generally along the mooring line 345'.

Next, the tanker (such as export vessel 120 of FIG. 1A) is positioned in proximity to the offloading buoy. The tanker is then moored to the offloading buoy by connecting a hawser line from the tanker to the offloading buoy.

The purpose for the mooring steps is to offload hydrocarbons from the FPV to the tanker. To do this, an operative connection is made between a first fluid jumper line to the offloading buoy. The first fluid jumper line carries production fluids from the FPV to the offloading buoy. An example is offloading jumper 115 of FIGS. 1A and 5. Then, operative connection is made between an offloading hose and the offloading buoy. The offloading hose preferably has buoyancy. The floating offloading hose carries fluids from the offloading jumper to the tanker. An example is offloading hose 130 of FIGS. 1A and 5. A fluid connector is provided for this connection. An example is the connector 166 of FIG. 4. The connection may be at the offloading buoy, or on a component in proximity to the offloading buoy. Hence, the term "operative connection" does not require immediate connection at the offloading buoy.

The offloading buoy is moored by a mooring line, such as vertical mooring line 145. Either of the offloading buoy or the mooring line may optionally provide a riser connector for supporting a riser and a production export hose to the FPV. An example of such a riser connector is the gooseneck 146 of FIG. 4.

The method may include unloading a fluid from the floating production vessel to the tanker. The fluid may be unloaded using a fluid conduit or conduits. For example, the fluid may be unloaded through the first fluid jumper line, the offloading hose, and/or a fluid conduit connector. The method may further include transporting the fluid to a second location. Exemplary second locations include an offshore import terminal, an onshore import terminal, and combinations thereof. The fluid may include, for example, petroleum hydrocarbons. Exemplary petroleum hydrocarbons include crude oil, natural gas, combinations thereof and portions thereof.

A description of certain embodiments of the inventions has been presented above. However, the scope of the inventions is defined by the claims that follow. Each of the appended claims defines a separate invention, which for infringement purposes is recognized as including equivalents to the various elements or limitations specified in the claims.

Various terms have also been defined, above. To the extent a claim term has not been defined, it should be given its broadest definition that persons in the pertinent art have given that term as reflected in printed publications, dictionaries and issued patents.

What is claimed is:

1. A combined riser, offloading and mooring system for the offloading of hydrocarbons from a floating production vessel to an export tanker, the floating production vessel receiving the hydrocarbons from a production riser and delivering them to the tanker through an offloading fluid jumper line, the system comprising:

an offloading buoy system for supporting the production riser and fluid jumper line, the offloading buoy system comprising:

at least one offloading buoy mooring line forming a mooring line axis from an earth mudline;

an offloading buoy connected to the at least one offloading buoy mooring line, the offloading buoy being disposed substantially in the mooring line axis;

a riser buoy, wherein the riser buoy:

is submerged beneath the offloading buoy is also moored by the offloading buoy mooring line;

is also disposed substantially in the mooring line axis formed by the at least one offloading buoy mooring line; and is connected to the offloading buoy by an inter-buoy mooring line;

a fluid conduit connector for providing fluid communication between said fluid jumper line from the floating production vessel and an offloading hose to the export tanker; and a riser connector providing fluid communication between the production riser and a production jumper to the floating production vessel said riser connector being tied to said at least one offloading buoy mooring line;

at least one set of FPV mooring lines for securing the floating production vessel to the offloading buoy system; and a hawser line for connecting the tanker to the offloading buoy system.

2. The combined riser, offloading and mooring system of claim 1, wherein the offloading buoy system further comprises a turntable for receiving the hawser line, the turntable being configured to permit the tanker to pivot.

3. The combined riser, offloading and mooring system of claim 1, wherein:

the offloading buoy system further comprises a turntable disposed on a top surface of the offloading buoy; and the hawser line connects to the offloading buoy.

4. The system of claim 1, wherein:

the offloading buoy system further comprises a turntable disposed proximate a top surface of the offloading buoy for receiving the hawser line; and the offloading buoy and connected turntable are submerged.

5. The system of claim 1, wherein:

the offloading buoy system further comprises a turntable disposed on a top surface of the offloading buoy for receiving the hawser line; and the offloading buoy and connected turntable are at the ocean surface.

6. The system of claim 1, wherein the fluid conduit connector defines a gooseneck supported below the ocean surface by the offloading buoy mooring line such that:

the production riser connects to a first end of the gooseneck; and a production jumper connects to a second end of the gooseneck, and delivers production fluids from the gooseneck to the floating production vessel.

7. The system of claim 1, wherein the at least one set of FPV mooring lines are connected to the offloading buoy system.

8. The system of claim 1, wherein the at least one set of FPV mooring lines are connected to the offloading buoy system at the offloading buoy.

9. The system of claim 1, wherein the at least one set of FPV mooring lines are connected to the offloading buoy system at the riser connector.

10. The system of claim 1, wherein the mooring line axis is substantially vertical with respect to the earth mudline.

11. The system of claim 1, wherein the production riser defines a catenary riser for delivering production fluids to the riser connector.

12. The system of claim 1, wherein the production riser defines a riser tower for delivering production fluids to the riser connector.

13. An offloading buoy system for an ocean environment, comprising:

a substantially vertical offloading mooring line secured to the ocean bottom;

an offloading buoy moored by the mooring line, the offloading buoy being disposed substantially in an axis formed by the offloading mooring line;

a fluid conduit connector for providing fluid communication between first and second fluid lines, the first fluid line being a jumper line carrying fluids from a floating production vessel, and the second fluid line being a floating offloading hose carrying those fluids to a tanker;

a riser connector disposed along the offloading mooring line for supporting a riser and for providing fluid communication between a production riser and a production jumper to the floating production vessel;

a floating production vessel mooring line for tethering the floating production vessel to the offloading buoy system; and a hawser line for connecting the tanker to the offloading buoy.

14. The offloading buoy system of claim 13, further comprising:

a submerged riser buoy moored by the offloading mooring line; and an inter-buoy mooring line for connecting the riser buoy to the offloading buoy.

15. The offloading buoy system of claim 13, further comprising a turntable for the hawser line connection, the turntable being configured to permit the tanker to pivot.

16. The offloading buoy system of claim 13, further comprising a turntable for receiving the hawser line, and wherein the turntable is disposed on a top surface of the offloading buoy.

17. The offloading buoy system of claim 13, further comprising a turntable for the hawser line connection, and wherein:

the turntable is disposed on a top surface of the offloading buoy; and the offloading buoy and connected turntable are submerged.

18. The offloading buoy system of claim 13, further comprising a turntable for connecting to the hawser line, and wherein:

the turntable is disposed proximate a top surface of the offloading buoy; and the offloading buoy and connected turntable are at the ocean surface.

19. The offloading buoy system of claim 13, further comprising:

a gooseneck supported in the ocean environment, the gooseneck having a first end that connects to the production riser, and a second end that connects to a production export line for delivering production fluids from the gooseneck to the floating production vessel.

20. A method for mooring a floating production vessel and an export tanker for the offloading of fluids in a marine environment, comprising:

positioning an offloading buoy system at a selected location in a marine environment, the offloading buoy system comprising:

at least one offloading buoy mooring line forming a vertical axis with a mudline in the marine environment;

an offloading buoy moored by the at least one offloading buoy mooring line, the offloading buoy being disposed substantially in a vertical axis formed by the at least one offloading buoy mooring line;

a fluid conduit connector for providing fluid communication between first and second fluid lines, the first fluid line being a jumper line carrying fluids from a floating production vessel, and the second fluid line being a floating offloading hose carrying those fluids to a tanker;

a riser connector disposed along the vertical mooring line for supporting a riser;

an FPV mooring line for tethering the floating production vessel to the offloading buoy system; and a hawser line for connecting the tanker to the offloading buoy;

positioning the tanker in proximity to the offloading buoy system;

mooring the tanker to the offloading buoy system by connecting the tanker to the offloading buoy system by means of a hawser line;

positioning the floating production vessel in proximity to the offloading buoy system; and mooring the floating production vessel by connecting the floating production vessel to the offloading buoy system by means of mooring lines.

21. The method of claim 20, further comprising:

unloading a fluid from the floating production vessel to the tanker through the fluid conduit connector, first fluid line and second fluid line; and transporting the fluid to a second location.

22. The method of claim 21, wherein the fluid includes petroleum hydrocarbons.

23. The method of claim 20, wherein the offloading buoy system further comprises a turntable for receiving the hawser line, the turntable being disposed on a top surface of the offloading buoy, and being configured to permit the tanker to pivot.

24. The method of claim 20, wherein the offloading buoy system further comprises a turntable for receiving the hawser line, the turntable being disposed on a top surface of the offloading buoy, and wherein the offloading buoy and connected turntable are submerged.

25. The method of claim 20, wherein the offloading buoy system further comprises a turntable for receiving the hawser line, the turntable being disposed on a top surface of the offloading buoy, and wherein the offloading buoy and connected turntable are at the ocean surface.

26. A method for mooring a floating production vessel and an export tanker for the offloading of hydrocarbons in a marine environment, comprising:

positioning the floating production vessel at a selected location in a marine body;

positioning an offloading buoy in proximity to the floating production vessel;

mooring the floating production vessel by connecting mooring lines from the floating production vessel to the offloading buoy system;

positioning the tanker in proximity to the offloading buoy;

mooring the tanker to the offloading buoy by connecting a hawser line from the floating production vessel to the offloading buoy, wherein either the offloading buoy or the mooring line provides a riser connector for supporting a riser and a production export hose to the floating production vessel;

operatively connecting a first fluid line to the offloading buoy, the first fluid line being a jumper line carrying fluids from the floating production vessel to the offloading buoy; and operatively connecting a second fluid line to the offloading buoy, the second fluid line being a floating offloading hose carrying fluids from the first fluid jumper line to the tanker.

27. The method of claim 26, further comprising:

unloading a fluid from the floating production vessel to the tanker through the first fluid line and second fluid line; and transporting the fluid to a second location.

28. The method of claim 27, wherein the fluid includes petroleum hydrocarbons.

29. A method of producing petroleum hydrocarbon fluids, comprising:

mooring a floating production vessel in a marine environment by connecting the floating production vessel to an offloading buoy system using mooring lines, the offloading buoy system comprising:

at least one offloading buoy mooring line forming a vertical axis with a mudline in the marine environment;

an offloading buoy moored by the at least one offloading buoy mooring line, the offloading buoy being disposed substantially in a vertical axis formed by the at least one offloading buoy mooring line;

a fluid conduit connector for providing fluid communication between first and second fluid lines, the first fluid line being a jumper line carrying fluids from a floating production vessel, and the second fluid line being a floating offloading hose carrying those fluids to a tanker;

a riser connector disposed along the vertical mooring line for supporting a riser;

an FPV mooring line for tethering the floating production vessel to the offloading buoy system; and a hawser line for connecting a tanker to the offloading buoy;

mooring a tanker to the offloading buoy system by connecting the tanker to the offloading buoy system using the hawser line;

unloading a fluid including petroleum hydrocarbons from the floating production vessel to the tanker through the fluid conduit connector, first fluid line, fluid conduit connector, and second fluid line; and transporting the fluid to a second location.

* * * * *